US009776772B2

(12) United States Patent
Tada et al.

(10) Patent No.: US 9,776,772 B2
(45) Date of Patent: Oct. 3, 2017

(54) BAYONET CONNECTION STRUCTURE BETWEEN CONTAINER MOUTH PORTION AND CAP

(75) Inventors: Atsushi Tada, Tokyo (JP); Mitsuaki Shaduki, Sanyo Onoda (JP)

(73) Assignee: CANYON CO., LTD., Sanyo Onoda-shi, Yamaguchi (JP)

( * ) Notice: Subject to any disclaimer, the term of this patent is extended or adjusted under 35 U.S.C. 154(b) by 0 days.

(21) Appl. No.: 14/116,552

(22) PCT Filed: May 11, 2012

(86) PCT No.: PCT/JP2012/003096

§ 371 (c)(1),
(2), (4) Date: Nov. 8, 2013

(87) PCT Pub. No.: WO2012/153540

PCT Pub. Date: Nov. 15, 2012

(65) Prior Publication Data

US 2014/0110439 A1 Apr. 24, 2014

(30) Foreign Application Priority Data

May 12, 2011 (JP) ..... 2011-107708

(51) Int. Cl.

| | |
|---|---|
| ***B67D 7/58*** | (2010.01) |
| ***B65D 43/02*** | (2006.01) |
| ***B65D 41/04*** | (2006.01) |
| ***B05B 11/00*** | (2006.01) |
| ***B65D 41/06*** | (2006.01) |

(52) U.S. Cl.
CPC ..... *B65D 43/02* (2013.01); *B05B 11/001* (2013.01); *B65D 41/0471* (2013.01); *B65D 41/06* (2013.01); *B05B 11/3011* (2013.01)

(58) Field of Classification Search
USPC ..... 222/383.1, 372.2, 321.1–321.9, 153.01, 222/153.09
See application file for complete search history.

(56) References Cited

U.S. PATENT DOCUMENTS 3,061,202 A * 10/1962 Tyler ..... 239/333
3,587,940 A * 6/1971 Ellis ..... 222/383.1
3,650,473 A * 3/1972 Malone ..... 239/333
(Continued)

*Primary Examiner* — Patrick M Buechner
*Assistant Examiner* — Michael J Melaragno
(74) *Attorney, Agent, or Firm* — Muncy, Geissler, Olds & Lowe, P.C.

(57) ABSTRACT

A bayonet connection structure between a container mouth portion and a cap is disclosed. The cap includes multiple slip prevention claws spaced apart from each other. One of the slip prevention claws is elastically displaceable in a radial direction. A rotation prevention projection is provided between the elastically-displaceable slip prevention claw and the other slip prevention claws. The mouth portion has a hollow cylindrical portion with an outer circumferential surface provided with multiple slip prevention claw (SPC) engagement portions for the slip prevention claws. The SPC engagement portions are as many as the slip prevention claws. Each of the SPC engagement portions has an end in a clockwise direction provided with a rotation prevention stopper. The mouth portion includes a rotation prevention rib to be got over by the rotation prevention projection of the cap when the cap is rotated.

12 Claims, 9 Drawing Sheets

(56) References Cited

U.S. PATENT DOCUMENTS

| | | | | |
|---|---|---|---|---|
| 3,685,739 | A * | 8/1972 | Vanier | 239/333 |
| 3,785,532 | A * | 1/1974 | Cooprider | 222/207 |
| 4,589,573 | A * | 5/1986 | Tada | 222/153.13 |
| 5,810,209 | A * | 9/1998 | Foster | 222/383.1 |
| 5,845,820 | A * | 12/1998 | Foster | 222/383.1 |
| 6,138,873 | A * | 10/2000 | Gramola | 222/153.14 |
| 6,155,462 | A * | 12/2000 | Brecheisen et al. | 222/153.09 |
| 6,315,167 | B2 * | 11/2001 | Brecheisen et al. | 222/153.09 |
| 6,578,742 | B1 * | 6/2003 | Schuckmann | 222/383.1 |
| 6,641,003 | B1 * | 11/2003 | Foster et al. | 222/383.1 |
| 8,864,052 | B2 * | 10/2014 | Foster et al. | 239/333 |
| 8,881,953 | B2 * | 11/2014 | Dennis | 222/382 |
| 2004/0074928 | A1 * | 4/2004 | Joseph Maas et al. | 222/383.1 |
| 2004/0245204 | A1 * | 12/2004 | Suffa | 215/224 |
| 2006/0086763 | A1 * | 4/2006 | Foster | 222/383.1 |
| 2006/0289679 | A1 * | 12/2006 | Johnson et al. | 239/333 |
| 2007/0215646 | A1 * | 9/2007 | Foster | 222/383.1 |
| 2007/0215647 | A1 * | 9/2007 | Foster et al. | 222/383.1 |
| 2007/0295758 | A1 * | 12/2007 | Foster et al. | 222/383.1 |
| 2008/0149587 | A1 * | 6/2008 | Sweeton et al. | 215/332 |
| 2008/0257913 | A1 * | 10/2008 | Contiero | 222/383.1 |
| 2008/0277430 | A1 * | 11/2008 | Maas et al. | 222/376 |
| 2009/0152304 | A1 * | 6/2009 | Foster | 222/340 |
| 2009/0308897 | A1 * | 12/2009 | Foster et al. | 222/383.1 |
| 2011/0024465 | A1 * | 2/2011 | Roosel et al. | 222/321.1 |
| 2011/0121039 | A1 * | 5/2011 | Dennis | 222/383.1 |
| 2011/0240681 | A1 * | 10/2011 | Foster et al. | 222/383.1 |
| 2012/0241474 | A1 * | 9/2012 | Dennis | 222/137 |
| 2014/0239018 | A1 * | 8/2014 | Maas et al. | 222/383.1 |

* cited by examiner

BAYONET CONNECTION STRUCTURE BETWEEN CONTAINER MOUTH PORTION AND CAP

TECHNICAL FIELD

The present invention relates to a bayonet connection structure between a mouth portion of a container where a pump dispenser is mounted via a cap, and the cap.

BACKGROUND ART

Conventionally, a pump dispenser is generally manufactured separately from a container, and is used as a jet container with a jet function as being connected to a mouth portion of the container via a cap.

As a connection structure between the mouth portion (a neck portion) of the container (a bottle) and the cap as described above, various types are present, such as those of screwing or fitting-in. Among these, an example of a connection by using two motions, "a pushing motion" and "a rotating motion", is a bayonet connection.

This is useful because the operation is simple and fixation force is reliable.

As an example of a bayonet connection structure, Patent Literature 1 (cap mount mechanism) describes a structure as below.

That is, the patent specification describes that at least three bayonet provisions are formed on an outer surface of a neck portion of a bottle, lugs as many as the bayonet provisions are formed on an outer surface of a cap and configured to releasably lock by three or more bayonet mechanisms and, compared to a structure using two or more bayonet mechanisms, the cap does not rock and therefore the bottle and the cap are reliably sealed together.

CITATION LIST

Patent Literature

PTL 1: U.S. Pat. No. 6,032,814

SUMMARY OF INVENTION

Technical Problem

However, in the cap mount mechanism described in Patent Literature 1, both of a cap slip prevention function and a rotation prevention function are achieved by the bayonet provisions and the lugs. Therefore, if opening and closing are repeated several times, the bayonet provisions on a bottle side may be disadvantageously crushed or abraded.

The present invention was made in view of these circumstances, and has an object of providing a bayonet connection structure between a container mouth portion and a cap in which a crush and abrasion of a rotation prevention portion on a mouth portion (neck portion) side of the container (a bottle) is prevented.

Solution to Problems

The inventor has diligently conducted studies to solve the problems described above and found that the problems can be solved by providing separate mechanisms for slip prevention and rotation prevention as measures against the above, thereby completing the present invention.

That is, the present invention resides in (1) a bayonet connection structure between a mouth portion of a container where a pump dispenser is mounted via a cap, and the cap, wherein the cap includes a plurality of slip prevention claws spaced apart from each other in a circumferential direction on an inner circumferential surface, one of the plurality of slip prevention claws is a slip prevention claw elastically displaceable in a radial direction, and a rotation prevention projection extending in an axial direction is provided between the elastically-displaceable slip prevention claw and each of the other slip prevention claws, and the mouth portion of the container has a hollow cylindrical portion with an outer circumferential surface provided with a plurality of slip prevention claw engagement portions with which the plurality of slip prevention claws of the cap engage, the slip prevention claw engagement portions being as many as the plurality of slip prevention claws, each of the slip prevention claw engagement portions engaging with the other slip prevention claws has an end in a clockwise direction provided with a rotation prevention stopper adjacently extending in the axial direction, and the mouth portion further includes a rotation prevention rib extending in the axial direction, the rotation prevention rib to be got over by the rotation prevention projection of the cap when the cap is rotated.

The present invention resides in (2) the bayonet connection structure between the mouth portion of the container and the cap according to (1) above, wherein the number of the plurality of slop prevention claws are three, the number of rotation prevention projections is two, the number of the plurality of slip prevention claw engagement portions is three, the number of rotation prevention stoppers is two, and the number of rotation prevention ribs is two.

The present invention resides in (3) the bayonet connection structure between the mouth portion of the container and the cap according to (1) or (2) above, wherein the pump dispenser includes a case body supporting a pump and the cap, and the case body and the cap are integrally formed.

The present invention resides in (4) the bayonet connection structure between the mouth portion of the container and the cap according to (1) and (2) above, wherein the pump dispenser includes a case body supporting a pump and the cap, the case body and the cap are formed of separate members, and the case body and the cap are mounted by fitting.

The present invention resides in (5) the bayonet connection structure between the mouth portion of the container and the cap between according to any one of (1) to (4) above, wherein the pump dispenser is a trigger pump dispenser.

The present invention resides in (6) the connection structure between the mouth portion of the container and the cap according to any one of (1) to (4) above, wherein the pump dispenser is a push pump dispenser.

The present invention resides in (7) the bayonet connection structure between the mouth portion of the container and the cap according to any one of (1) to (4) above, wherein the pump dispenser is a pressure accumulator pump dispenser.

Advantageous Effects of Invention

According to the bayonet connection structure between the container mouth portion and the cap, the cap includes a plurality of slip prevention claws spaced apart from each other in a circumferential direction on an inner circumferential surface, one of the plurality of slip prevention claws is a slip prevention claw elastically displaceable in a radial direction, and a rotation prevention projection extending in an axial direction is provided between the elastically-displaceable slip prevention claw and each of the other slip prevention claws, and the mouth portion of the container has a hollow cylindrical portion with an outer circumferential surface provided, with a plurality of slip prevention claw engagement portions with which the plurality of slip prevention claws of the cap engage, the slip prevention claw engagement portions being as many as the plurality of slip prevention claws, each of the slip prevention claw engagement portions engaging with the other slip prevention claws has an end in a clockwise direction provided with a rotation prevention stopper adjacently extending in the axial direction, and the mouth portion further includes a rotation prevention rib extending in the axial direction, the rotation prevention rib to be got over by the rotation prevention projection of the cap when the cap is rotated.

Therefore, a crush and abrasion of the rotation prevention stopper extending in the axial direction and the rotation prevention rib extending in the axial direction on the container mouth portion side can be prevented.

Also, the pump dispenser includes a case body supporting a pump, and the cap, and when the case body and the cap are integrally formed, the number of form blocks to form the case body and the cap by using synthetic resin is less, thereby reducing manufacturing cost.

Furthermore, the pump dispenser includes the case body supporting the pump, and the cap, and when the case body and the cap are formed of separate members and the case body and the cap are mounted by fitting, the case body and the cap can be each formed of a suitable synthetic resin.

DESCRIPTION OF EMBODIMENT

Figure 1:
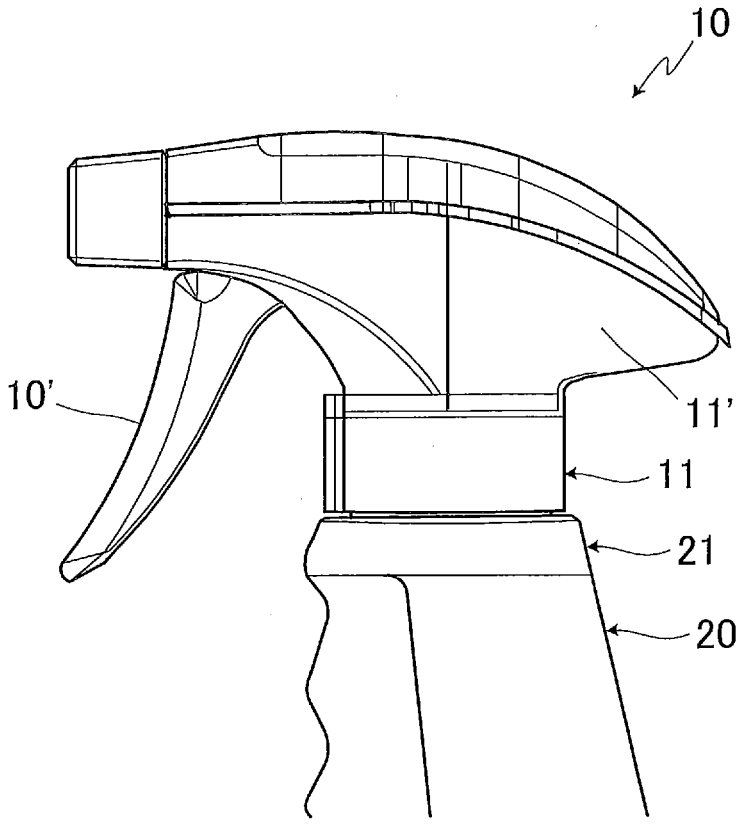
FIG. 1 is a side view of an embodiment of a bayonet connection structure between a container mouth portion and a cap according to the present invention.

A preferable embodiment of the present invention is described in detail below with reference to the drawing as required. Note in the drawings that identical components are provided with a same reference numeral, and redundant description is omitted.

Also, positional relations such as upper, lower, left, and right positions are based on positional relations depicted in the drawings unless otherwise specified.

Furthermore, dimension ratios of the drawings are not restricted to those as depicted.

As depicted in FIG. 1 to FIG. 10, a bayonet connection structure between a mouth portion 21 of a container 20 and a cap 11 according to an embodiment of the present invention has a unique structure.

The cap 11 has two types of portions having different functions, that is, slip prevention claws 12 and 13 and rotation prevention projections 14.

That is, the cap 11 includes the plurality of slip prevention claws 12 and 13 spaced apart from each other in a circumferential direction on an inner circumferential surface, one of the plurality of slip prevention claws 12 and 13 is the slip prevention claw 12 elastically displaceable in a radial direction, and the rotation prevention projections 14 extending in an axial direction are each provided between the elastically-displaceable slip prevention claw 12 and each of the other slip prevention claws 13.

On the other hand, the mouth portion 21 of the container 20 includes slip prevention claw engagement portions 23 (each having a rotation prevention stopper 24) and rotation prevention ribs 25 functioning correspondingly to the slip prevention claws 12 and 13 and the rotation prevention projections 14 of the cap 11.

That is, the mouth portion 21 of the container 20 has a hollow cylindrical portion 22 with an outer circumferential surface provided with the plurality of slip prevention claw engagement portions 23 with which the plurality of slip prevention claws 12 and 13 of the cap 11 engage, the slip prevention claw engagement portions 23 being as many as the plurality of slip prevention claws 12 and 13, each of the slip prevention claw engagement portions 23 engaging with the other slip prevention claws 13 has an end in a clockwise direction provided with the rotation prevention stopper 24 adjacently extending in an axial direction, and the mouth portion 21 further includes the rotation prevention ribs 25 extending in the axial direction, each the rotation prevention ribs 25 to be got over by a relevant one of the rotation prevention projections 14 of the cap 11 when the cap 11 is rotated.

FIG. 1 is a side view of the bayonet connection structure between the mouth portion 21 of the container 20 and a trigger pump dispenser 10 according to the present invention.

Figure 11:
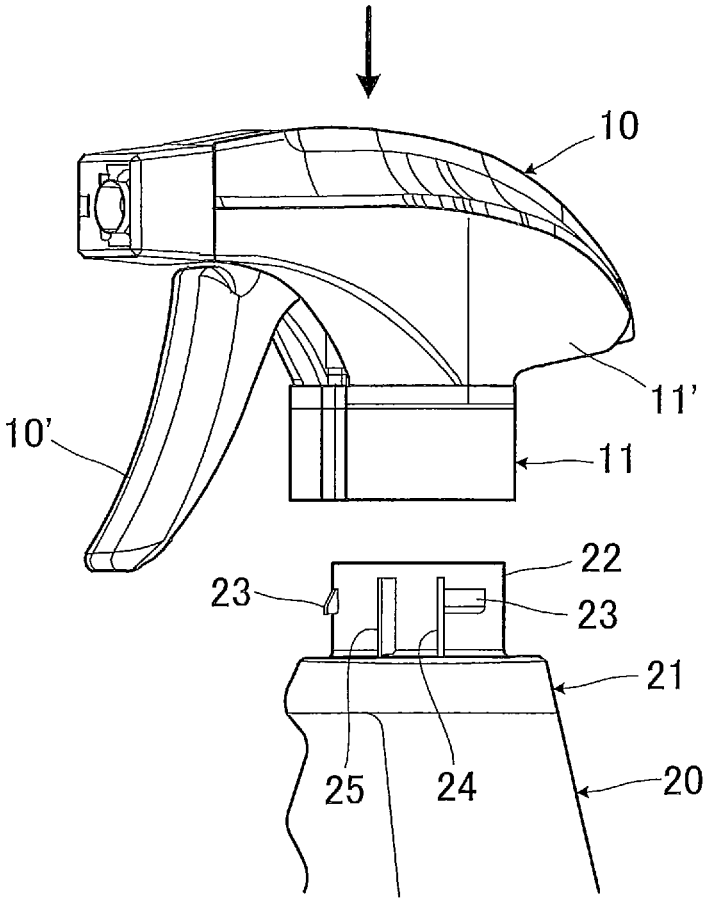
FIG. 11 is a side view of the state before the cap fits in the container mouth portion in the vertical direction.
Figure 12:
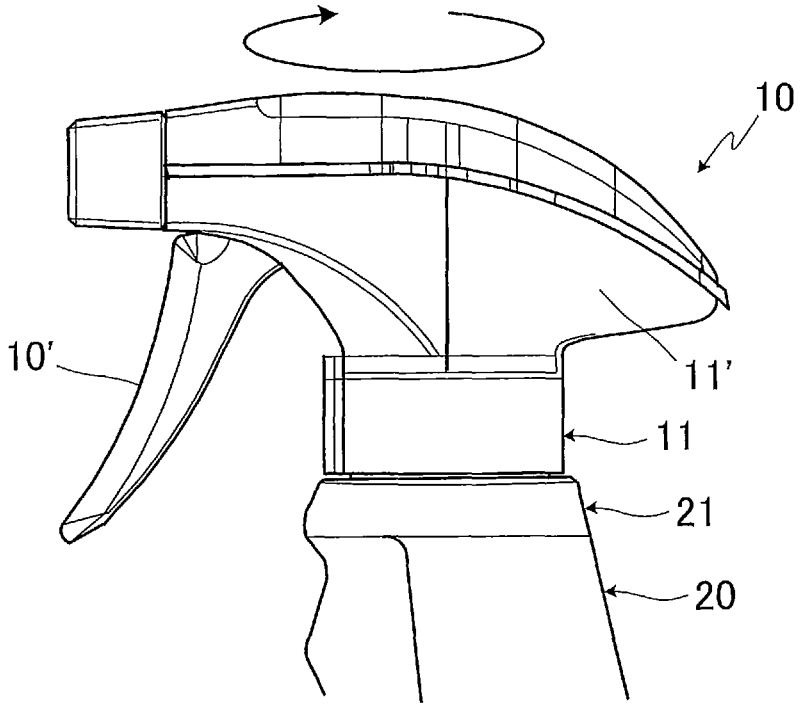
FIG. 12 is a side view of the state where the cap is rotated in the clockwise direction after the cap fits in the container mouth portion in the vertical direction.

Note that, as depicted in FIG. 1, FIG. 11, and FIG. 12, the trigger pump dispenser 10 includes a trigger 10' rotatably and pivotally mounted on a case body 11' supporting a pump (including an incorporation portion such as a cylinder, a piston, and a base portion).

Figure 2:
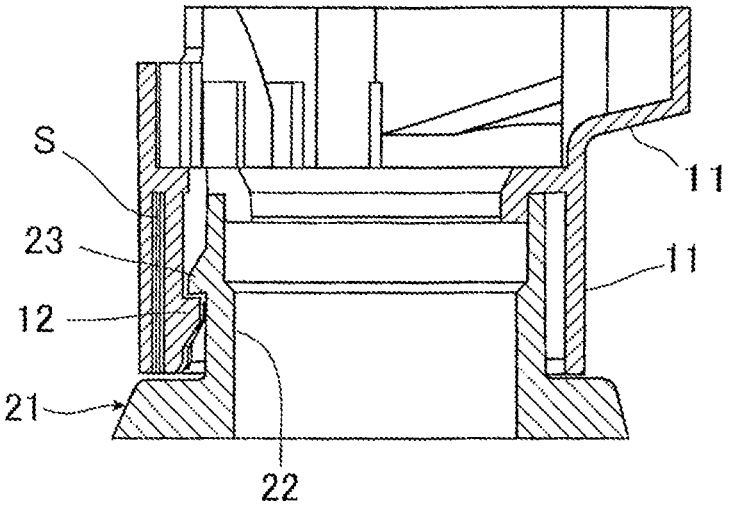
FIG. 2 is a vertical sectional view of the bayonet connection structure between the container mouth portion and the cap depicted in FIG. 1.

FIG. 2 is a vertical sectional view of the bayonet connection structure between the mouth portion 21 of the container 20 and the cap 11 depicted in FIG. 1, depicting the state where an elastically-displaceable slip prevention claw 12 and slip prevention claw engagement portions 23 of the mouth portion 21 engage with each other. A slit that is formed in the cap 11 and extends vertically (or an axial direction) is denoted with S. The slit S is shown in FIG. 3 and FIG. 4 as well.

Figure 3:
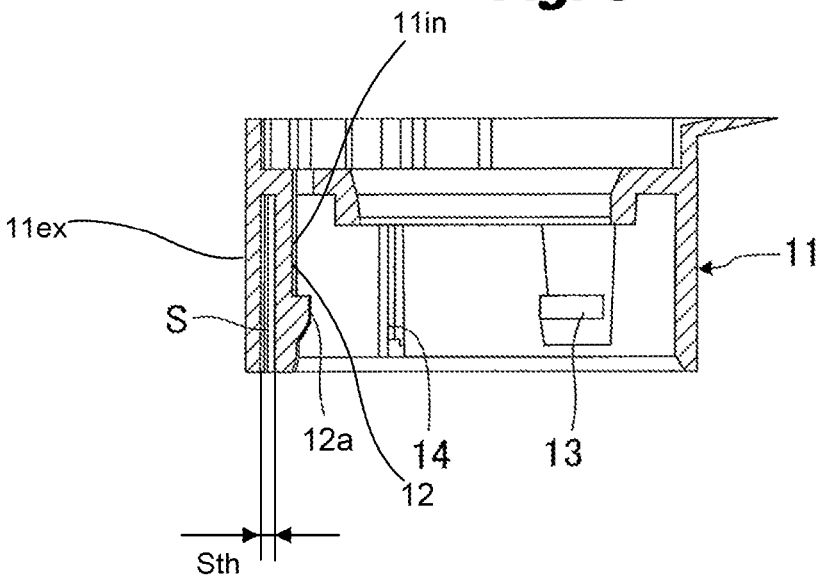
FIG. 3 is a vertical sectional view of the cap depicted in FIG. 1.
Figure 4:
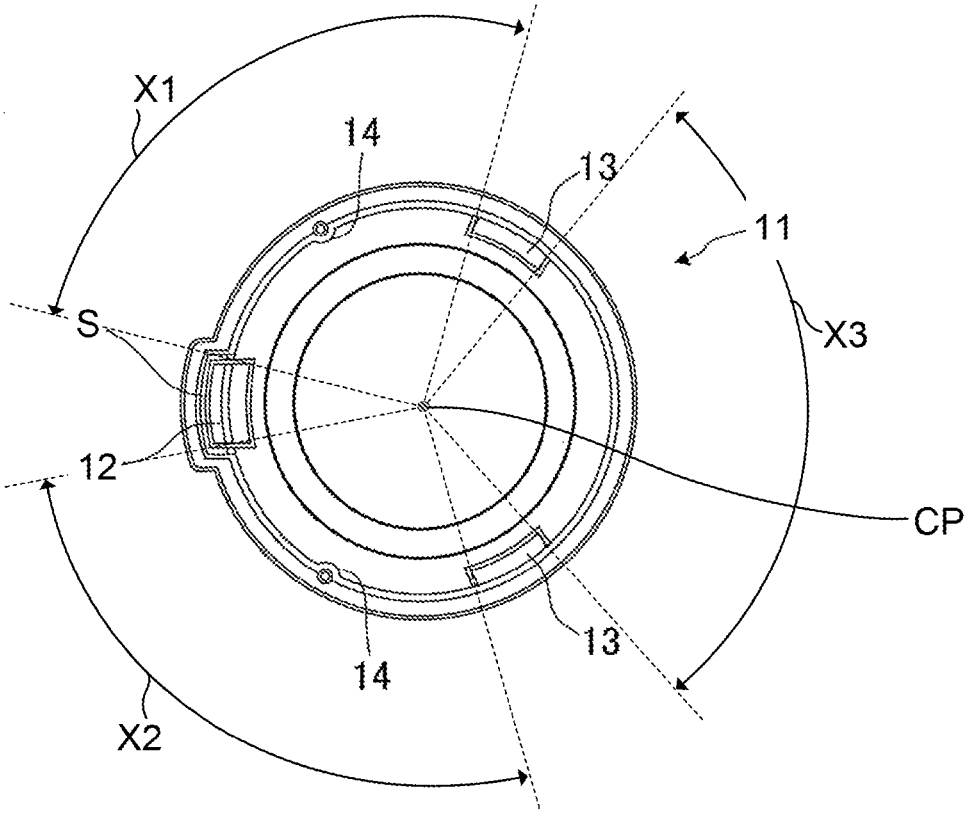
FIG. 4 is a plan view of the cap depicted in FIG. 3 when viewed from below.

FIG. 3 and FIG. 4 depict the cap 11. The cap 11 includes one elastically-displaceable slip prevention claw 12 (or elastic claw), two slip prevention claws 13 (or solid claws), and two rotation prevention projections 14 extending in the axial direction. The slit S, which is an empty space, is located behind the elastic claw 12 so that the elastic claw 12 is able to be elastically deformed outwardly. The slit S can be filled with a soft material like sponge or gel to the extend that the material does not prevent the elastic claw from deforming. The position of the slit S can be called as an opposite side from a projection portion 12*a* of the elastic claw 12. The thickness of the slit S, which is in the radial direction, is denoted with Sth. The degree of the maximum deformation of the slit S is determined by the thickness Sth because the slit S cannot be deformed beyond the range of the slit S. Behind the elastic claw 12, the slit S extends up-down direction (or the axial direction of the cap). In this embodiment, the slit S entirely extends from the distal end to the proximal end of the elastic claw 12. Also, the slit S is entirely sandwiched between the inner circumferential surface 11in and the outer circumferential surface 11*ex*. Thereby, the slit S is completely covered with these circumferential surfaces. In another embodiment, some openings, which connect to the slit S, may be provided on the surfaces 11in and/or 11*ex*.

In FIG. 4, two of the solid claws 13 and one of the elastic claw 12 are illustrated. In the embodiment, these claws are substantially evenly separated from each other. The intervals between them from the top view of the cap 11 are denoted with from X1 to X3. The interval between the solid claws 13 is with X3. The others are with X1 and X2. The degrees of the intervals X1 to X3 may vary because they are design matters but it is preferred to set X1 to X3 substantially equal (or X1=X2=X3). That is because any of claws 12 and 13 can match any of the engagement portions 23 of the mouth portion 21 shown in FIGS. 5 and 6 where these engagement portions 23 as well are separated from each other by the same interval(s) as that of the claws. The intervals X1 to X3 may be determined by an outer circumference length, or may be determined by an angle around a center point CP of the cap 11.

Figure 5:
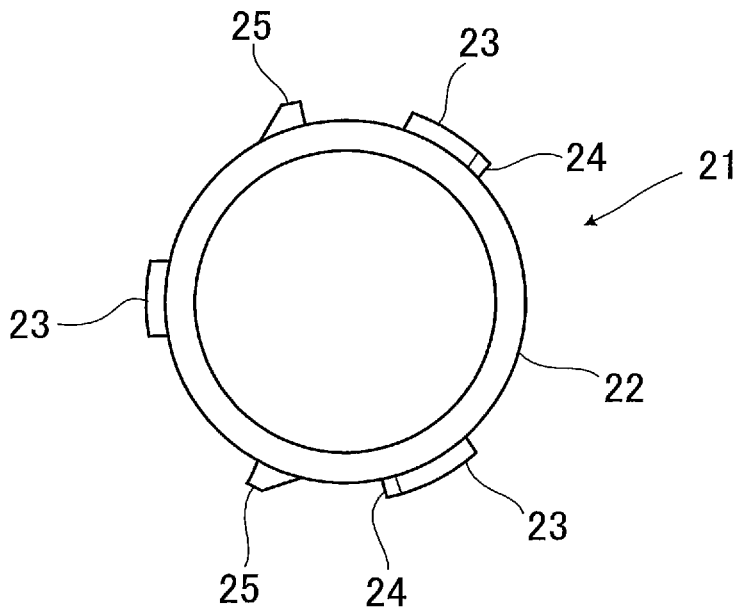
FIG. 5 is a side view of a hollow cylindrical portion of a container mouth portion depicted in FIG. 6.
Figure 6:
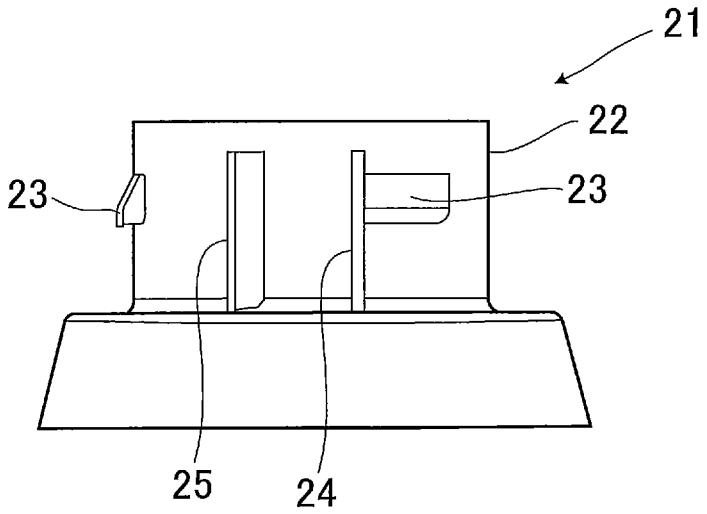
FIG. 6 is a side view of the container mouth portion depicted in FIG. 2.

FIG. 5 and FIG. 6 depict the mouth portion 21. The mouth portion 21 has an outer circumference of the hollow cylindrical portion 22 provided with three slip prevention claw engagement portions 23, two rotation prevention stoppers 24 extending in the axial direction, and two rotation prevention ribs 25 extending in the axial direction.

Figure 7:
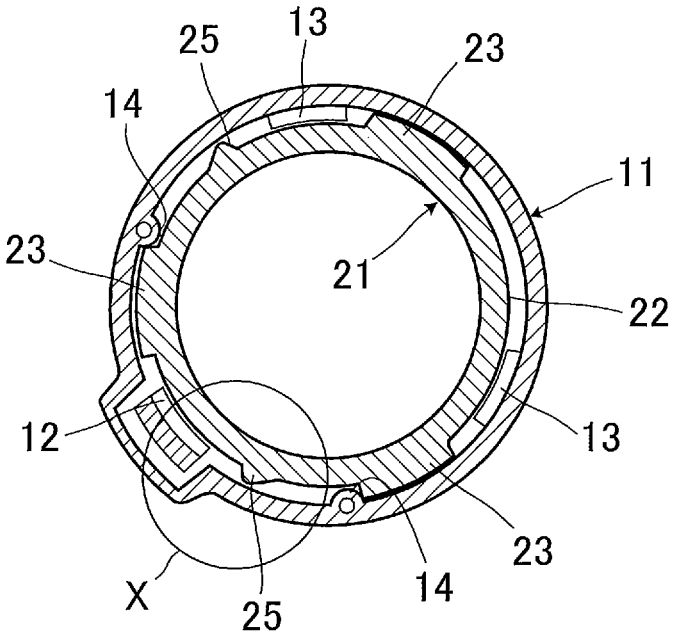
FIG. 7 is a sectional view of the mouth and the cap in a horizontal direction when the cap is inserted in the container mouth portion depicted in FIG. 1 in a vertical direction.
Figure 8:
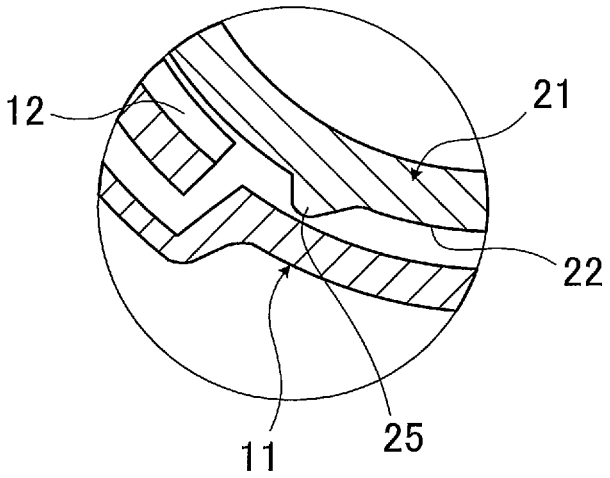
FIG. 8 is an enlarged view of a circle X portion of FIG. 7.

FIG. 7 and FIG. 8 depict the state where the cap 11 fits in the mouth portion 21 in the axial direction.

When the cap 11 fits in the mouth portion 21 in the axial direction, with the elastically-displaceable slip prevention claw 12 and the slip prevention claws 13 of the cap 11 not interfering with the slip prevention claw engagement portions 23 of the mouth portion 21, the cap 11 fits in the mouth portion 21 in the axial direction.

Figure 9:
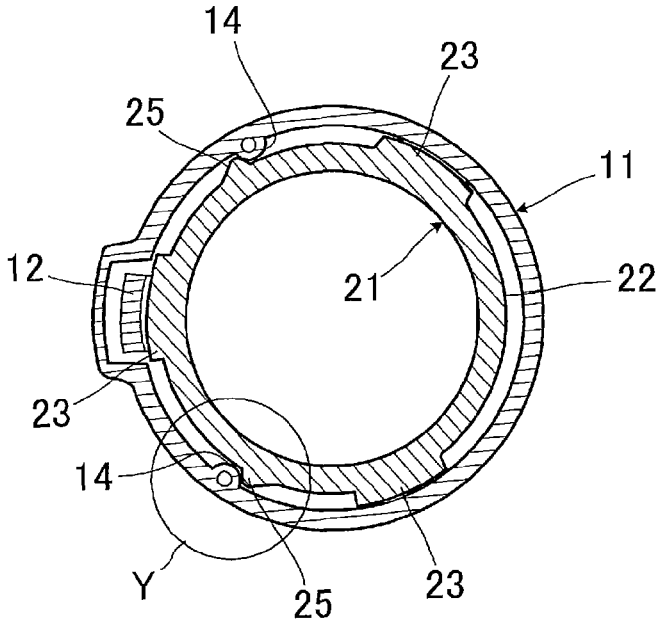
FIG. 9 is a sectional view of the mouth portion and the cap in the horizontal direction when the cap inserted in the container mouth portion depicted in FIG. 7 in the vertical direction is rotated in a clockwise direction.
Figure 10:
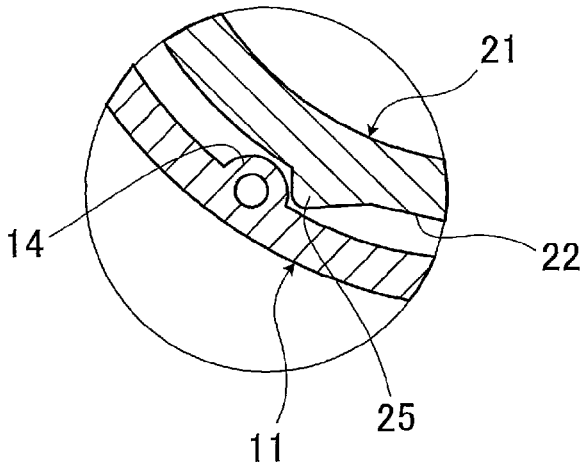
FIG. 10 is an enlarged view of a circle V portion of FIG. 9.

FIG. 9 and FIG. 10 depict the state where the cap 11 is rotated in a clockwise direction after the cap fits in the mouth portion 21 the axial direction.

When the cap 11 is strongly rotated in the clockwise direction from the state of FIG. 7 and FIG. 8, the rotation prevention projections 14 of the cap 11 extending in the axial direction each get over a relevant one of the rotation prevention ribs 25 of the mouth portion 21 extending in the axial direction in the course of rotation.

Here, an operator operating the cap 11 feels a resistance in the course of rotation, such as a click feeling or a collision feeling.

Also, at approximately the same time when the rotation prevention projections 14 extending in the axial direction get over the rotation prevention ribs 25 similarly extending in the axial direction, an end of each of the two slip prevention claws 13 of the cap 11 abuts on a relevant one of the rotation prevention stoppers 24 of the mouth portion 21 extending in the axial direction (refer to FIG. 5 and FIG. 6).

With this, the cap 11 is positioned in a rotating direction.

Furthermore, here, the elastically-displaceable slip prevention claw 12 and the slip prevention claws 13 of the cap 11 each engage with a relevant one of the slip prevention claw engagement portions 23 of the mouth portion 21 to prevent the cap 11 from slipping in the axial direction.

The cap 11 does not easily rotate from this state in a direction of returning to an original position.

To return to an original position, it is required to strongly rotate the cap with force.

FIG. 11 and FIG. 12 depict a procedure of mounting the trigger pump dispenser 10 including the cap 11 on the container 20 including the mouth portion 21.

FIG. 11 depicts the state before the trigger pump dispenser 10 is moved in the axial direction as indicated by an arrow to be inserted in the container 20 including the mouth portion 21.

For example, in this state, the container is filled with liquid.

FIG. 12 depicts the state where, after the trigger pump dispenser 10 is inserted in the container 20, the trigger pump dispenser 10 is rotated in a clockwise direction as indicated by an arrow to be mounted on the container 20.

Here, as described, above, the end of each of the slip prevention claws 13 of the cap 11 abuts on the relevant one of the rotation prevention stoppers 24 of the mouth portion 21, and the elastically-displaceable slip prevention claw 12 and the slip prevention claws 13 of the cap 11 each engage with the relevant one of the slip prevention claw engagement portions 23 of the mouth portion 21 to be positioned.

Also, to fill the container with liquid, the trigger pump dispenser 10 is rotated in the counterclockwise direction in the state depicted in FIG. 12 and then is pulled out upward for liquid filling or refilling.

Meanwhile, the following connection method between the mouth portion 21 of the container 20 and the cap 11 different from the method described above can be thought.

After the container 20 is filled with liquid, by fixing the positions of the trigger pump dispenser 10 and the container 20 and merely pressing them as they are, both can be set.

That is, with the elastically-displaceable slip prevention claw 12 and the slip prevention claws 13 of the cap 11 and the slip prevention claw engagement portion 23 of the mouth portion 21 being aligned to correspond to each other, when the cap 11 is considerably strongly pressed into the mouth portion 21 of the container 20, the elastically-displaceable slip prevention claw 12 becomes to have a spring action. Also, since the slip prevention claw 13 has slight elasticity, the elastically-displaceable slip prevention claw 12 and the slip prevention claws 13 and the slip prevention claw engagement portions 23 can engage with each other without cursing each of claws 12 and 13.

Also, after the cap 11 is rotated in a reverse rotating direction with respect to the mouth portion 21 of the container 20, the cap 11 is pulled out in the axial direction, thereby filling the container 20 with liquid.

Note that after filling the container 20 with liquid, the cap 11 can be mounted on the mouth portion. 21 of the container 20 by the above-described method.

According to the bayonet connection structure between the mouth portion 21 of the container 20 and the cap 11 according to the embodiment of the present invention, the following effects can be provided.

In the bayonet connection structure between the mouth portion 21 of the container 20 and the cap 11 according to an embodiment of the present invention, the cap 11 includes the plurality of slip prevention claws 12 and 13 spaced apart from each other in a circumferential direction on an inner circumferential surface, one of the plurality of slip prevention claws 12 and 13 is the slip prevention claw 12 elastically displaceable in a radial direction, and the rotation prevention projection 14 extending in the axial direction is provided between the elastically-displaceable slip prevention claw 12 and each of the other slip prevention claws 13, and the mouth portion 21 of the container 20 has the hollow cylindrical portion 22 with an outer circumferential surface provided with the plurality of slip prevention claw engagement portions 23 with which the plurality of slip prevention claws 12 and 13 of the cap 11 engage, the slip prevention claw engagement portions 23 being as many as the plurality of slip prevention claws 12 and 13, each of the slip prevention claw engagement portions 23 engaging with the other slip prevention claws 13 has an end in a clockwise direction provided with the rotation prevention stopper 24 adjacently extending in the axial direction, and the mouth portion 21 further includes rotation prevention rib 25 extending in the axial direction, the rotation prevention rib 25 to be gotten over by the rotation prevention projection 14 of the cap 11 when the cap 11 is rotated. Therefore, a crush and abrasion of the rotation prevention stoppers 24 and the rotation prevention ribs 25 on the mouth portion 21 side of the container 20 can be prevented.

Also, the trigger pump dispenser 10 includes the case body 11' supporting the pump, and the cap 11, and when the case body 11 and the cap 11 are integrally formed, the number of form blocks to form the case body 11' and the cap 11 by using synthetic resin is less, thereby reducing manufacturing cost.

Furthermore, the trigger pump dispenser 10 includes the case body 11' supporting the pump, and the cap 11, and when the case body 11' and the cap 11 are formed of separate members and the case body 11' and the cap 11 are mounted by fitting, the case body 11' and the cap 11 can be each formed of a suitable synthetic resin.

The pump dispenser of the present invention can be also applied to a different type other than the trigger pump dispenser 10.

Figure 13:
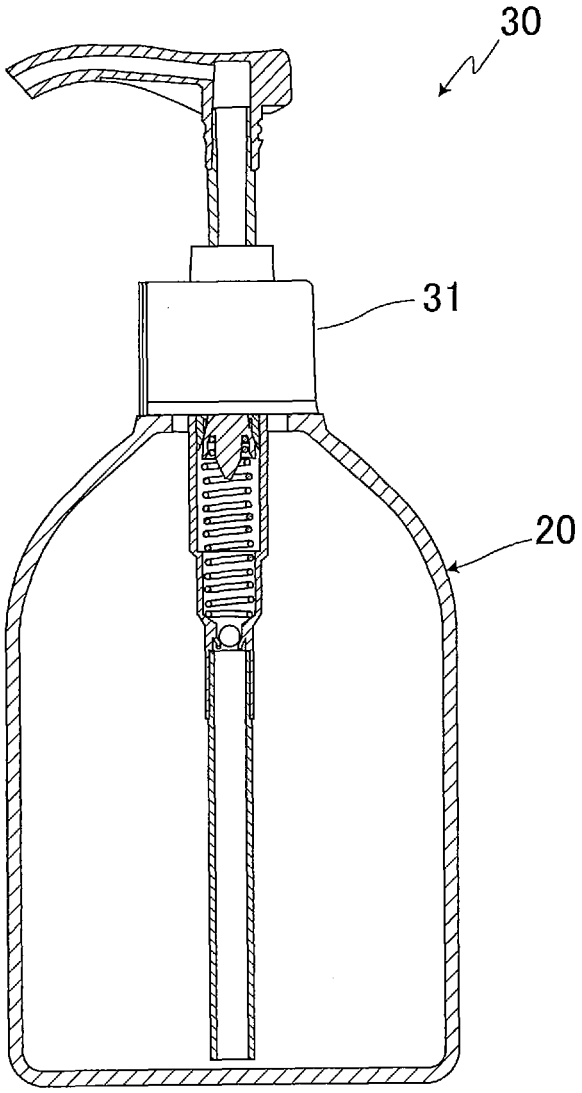
FIG. 13 is a partially-sectional side view when the bayonet connection structure according to the present invention between a container mouth portion and a cap is applied to a push pump dispenser.

For example, FIG. 13 is a partially-sectional side view when the bayonet connection structure according to the present invention between a mouth portion not shown of the container 20 and a cap 31 is applied to a push pump dispenser 30.

Note in FIG. 13 that the mouth portion is not viewable as being hidden by the cap 31.

Furthermore, the non-viewable mouth portion and the cap 31 are configured to be approximately identical to the mouth portion 21 and the cap 11 depicted in FIG. 1 to FIG. 12.

Still further, the trigger pump dispenser 10 and the push pump dispenser 30 can be naturally applied to those of a pressure accumulator type.

INDUSTRIAL APPLICABILITY

The bayonet connection structure between the container mount portion and the cap according to the present invention can be applied to other fields, such as cosmetic containers and coating containers, as long as the principles can be applied.

REFERENCE SIGNS LIST

10 . . . trigger pump dispenser
10' . . . trigger
11 . . . cap
11' . . . case body
12 . . . elastically-displaceable slip prevention claw
13 . . . slip prevention claw
14 . . . rotation prevention projection
20 . . . container
21 . . . mouth portion
22 . . . hollow cylindrical portion
23 . . . slip prevention claw engagement portion
24 . . . rotation prevention stopper
25 . . . rotation prevention rib
30 . . . push pump dispenser
31 . . . cap

The invention claimed is:

1. A bayonet connection structure between a mouth portion of a container and a cap on which a pump dispenser is mounted, the cap comprising:

an inner circumferential surface that is in a circular shape in a top view of the cap, at least three of slip prevention claws (12, 13) that are provided on the inner circumferential surface, each of the slip prevention claws having an inner inclined surface that faces obliquity downward, and the mouth portion comprising:

an outer circumferential surface that is in a circular shape in a top view of the mouth portion, three of engagement portions (23) that are arranged on the outer circumferential surface in correspondence with the slip prevention claws such that one of the engagement portions meets one of the slip prevention claws when the cap is engaged with the mouth portion, each of the engagement portions having an outer inclined surface that faces obliquity upward such that the inner inclined surfaces of the cap run over the outer inclined surfaces of the mouth portion when the cap is pressed downward, wherein a slit is formed behind one of the slip prevention claws, the slit extending in an axial direction such that the elastic claw is bent in a radial direction within the slit, having an opening that is disposed at a lower edge of the cap such that a lower portion of the slip prevention claw is more deformed than an upper portion of the slip prevention claw, the slip prevention claw being defined as an elastic claw (12), two of the slip prevention claws are defined as stable claws (13) behind which no slit is formed such that the stable claws are barely deformed in the radial direction, seen from the top view of the cap, where the elastic claw is positioned at 9 o'clock, the stable claws are positioned between 12 o'clock and 6 o'clock such that no portion of the stable claws are positioned between 6 o'clock and 12 o'clock, and no other elastic claw is provided, one of the engagement portions that correspond to one of the stable claws is provided with a stopper (24) at an end thereof, the end being positioned at a downstream side of the engagement portion in a clockwise direction from the top view, the stopper is configured with an upper portion and a lower portion, both of which are linearly arranged in the axial direction of the mouth portion, the upper portion protruding upward from the outer inclined surface of the engagement portion in the axial direction so that the inner inclined surface of the corresponding stable claw is aligned with the outer inclined surface by contacting an end of the inner inclined surface to the stopper, and the lower portion protruding downward from the outer inclined surface in the axial direction so that the stable claw is blocked to further rotate toward the clockwise direction when the stable claw is engaged with the engagement portion, a rotation prevention projection (14), which extends in the axial direction and protrudes inwardly in the radial direction, is provided on the inner circumferential surface of the cap, being distant from one of the stable claws by a projection distance in the clockwise direction, a rotation prevention rib, extends in the axial direction and protrudes outwardly in the radial direction, is provided on the outer circumferential surface of the mouth portion, being distant from the end of the stopper that corresponds to the stable claw in the clockwise direction by a rib distance that is the same as the projection distance so that, when the stable claw meets the stopper, the rotation prevention projection simultaneously gets over the rotation prevention rib.

2. The bayonet connection structure between the mouth portion of the container and the cap according to claim 1, wherein the pump dispenser includes a case body supporting a pump, and the cap, and the case body and the cap are integrally formed.

3. The bayonet connection structure between the mouth portion of the container and the cap according to claim 1, wherein the pump dispenser includes a case body supporting a pump and the cap, the case body and the cap are formed of separate members, and the case body and the cap are mounted by fitting.

4. The bayonet connection structure between the mouth portion of the container and the cap between according to claim 1, wherein the pump dispenser is a trigger pump dispenser.

5. The bayonet connection structure between the mouth portion of the container and the cap according to claim 1, wherein the pump dispenser is a push pump dispenser.

6. The bayonet connection structure between the mouth portion of the container and the cap according to claim 1, wherein the pump dispenser is a pressure accumulator pump dispenser.

7. The bayonet connection structure between the mouth portion of the container and the cap according to claim 1, wherein only one of the elastic claw is provided.

8. The bayonet connection structure between the mouth portion of the container and the cap according to claim 1, wherein the other of the slip prevention claw engagement portions also has the stopper having the protruding portions.

9. The bayonet connection structure between the mouth portion of the container and the cap according to claim 1, wherein the rotation prevention rib protrudes upward in the axial direction from the outer inclined surface of the mouth portion to the same height as the protruding portion of the stopper.

10. The bayonet connection structure between the mouth portion of the container and the cap according to claim 1, wherein the cap is provided with only three of the slip prevention claws; and the mouth portion is provided with only three of the engagement portions.

11. The bayonet connection structure between the mouth portion of the container and the cap according to claim 1, wherein the stable claws are positioned between 1 o'clock and 5 o'clock where the elastic claw is positioned at 9 o'clock.

12. The bayonet connection structure between the mouth portion of the container and the cap according to claim 1, wherein another rotation prevention projection (14), which extends in the axial direction and protrudes inwardly in the radial direction, is provided on the inner circumferential surface of the cap, being distant from the other of the stable claws by another projection distance in the anti-clockwise direction, another rotation prevention rib, extends in the axial direction and protrudes outwardly in the radial direction, is provided on the outer circumferential surface of the mouth portion, being distant from the end of the stopper that corresponds to the other stable claw in the anti-clockwise direction by another rib distance that is the same as the another projection distance so that, when the other stable claw meets the stopper, the another rotation prevention projection simultaneously gets over the another rotation prevention rib.

* * * * *